US007074140B1

(12) United States Patent
McNary

(10) Patent No.: US 7,074,140 B1
(45) Date of Patent: Jul. 11, 2006

(54) PUCK-DEFLECTING TRAINING DEVICE

(76) Inventor: David F. McNary, 12 Shields St., Woburn, MA (US) 01801

( * ) Notice: Subject to any disclaimer, the term of this patent is extended or adjusted under 35 U.S.C. 154(b) by 117 days.

(21) Appl. No.: 10/763,960

(22) Filed: Jan. 26, 2004

Related U.S. Application Data

(60) Provisional application No. 60/445,117, filed on Feb. 5, 2003.

(51) Int. Cl.
*A63B 69/00* (2006.01)

(52) U.S. Cl. ..... 473/446; 273/400

(58) Field of Classification Search ..... 273/400, 273/398, 401, 410; 473/476, 479, 173, 454, 473/446; 294/77; 256/24–26
See application file for complete search history.

(56) References Cited

U.S. PATENT DOCUMENTS 4,647,016 A * 3/1987 Doublet ..... 256/24
4,809,988 A * 3/1989 Hunter ..... 273/400
5,348,291 A * 9/1994 Scully ..... 473/454
6,199,833 B1 * 3/2001 Bilby et al. ..... 256/24
6,250,635 B1 * 6/2001 Chittenden ..... 273/400

* cited by examiner

*Primary Examiner*—Stephen Blau
*Assistant Examiner*—M. Chambers
(74) *Attorney, Agent, or Firm*—William Nitkin

(57) ABSTRACT

An ice hockey training device providing goalie training in preventing pucks, particularly deflected or "tipped" pucks, from entering the goal is disclosed. The device is disposed on a playing surface in front of a goal guarded by a goalie, the device having a plurality of vertically disposed puck deflectors arrayed in a parallel series through which array the puck is shot at the goal by a player and strikes a puck deflector member to be deflected at an angle from its original path of travel. The device can also include a base deflector resting on the playing surface which provides a planar surface disposed at an upward angle which can direct pucks hit by a player traveling on the playing surface to ride up onto the planar surface of the base deflector and be directed upwards at the goal. A plurality of angle members can be disposed on the base deflector to further deflect at different angles pucks traveling thereon.

2 Claims, 5 Drawing Sheets

PUCK-DEFLECTING TRAINING DEVICE

This application claims priority and benefit of a provisional patent application entitled S+S Tip Trainer, Ser. No. 60/445,117 filed Feb. 5, 2003, now pending.

BACKGROUND OF THE INVENTION

1. Field of the Invention

The structure of this invention resides in the area of sporting equipment and more particularly relates to a training device for use by ice hockey goalies which device causes tipping deflections of pucks hit at short range and provides goalie training in preventing deflected or "tipped" pucks from entering the goal.

2. History of the Prior Art

A hockey goalie stands in the crease in front of a hockey goal and attempts to stop pucks from entering the goal that are shot at the goal by members of the opposing team. The puck can be shot at the goal by members of the opposing team from a distance, at very close range or the puck can be shot or passed from one player to another and then shot at the goal, giving the goalie very little time to react to the puck's change in direction of movement. The puck can also be tipped, or deflected off the hockey stick blade, on its way toward the goal by a second player from a first player's shot, resulting in a different angle of puck movement toward the goal. Such tipped shots are more difficult for a goalie to catch or prevent from entering the goal because there is less time to gauge the direction of movement of the puck.

SUMMARY OF THE INVENTION

It is an object of the device of this invention, hereinafter referred to as a tip trainer, to duplicate the tipping deflections of pucks that frequently occur in a real ice hockey games for use by goalies during team practice and training sessions.

It is a further object of this invention to cause deflection of a puck near the goalie that is shot by a player at a distance from the goal so that the goalie can practice trying to stop or catch a puck that is deflected, or tipped, before coming into the goalie's vicinity.

It is a still further object of this invention to provide a device that will deflect the path of movement of pucks traveling in the air above the ice as well as pucks traveling along the surface of the ice.

It is yet a further object of this invention to provide a training device that is easy to ship, easy to assemble and easily maneuverable on the ice of an ice hockey rink or rink with synthetic ice such as plastic playing surfaces or equivalent. It should be understood that all references made to ice include such equivalent playing surfaces.

The device of this invention consists of a movable support framework having a top member from which a plurality of puck deflector members hang vertically therefrom arrayed parallel to one another. The device can be placed at a desired distance in front of the hockey goal during a practice session. The device in one embodiment can be placed between 6–12 feet in front of the goal. In use, a single player can shoot a puck at the device of this invention in front of the goal; and the puck, if it strikes one of the puck deflector members, will be deflected at an angle from its original path direction, such angle determined by the manner in which the puck strikes a puck deflector member, thus increasing the difficulty for the goalie in preventing the puck from entering the goal. This increase in difficulty in gauging the path of the deflected puck is desirable for providing specialized practice training to a goalie.

The framework of this invention consists of first and second upright members which are supported, respectively, on first and second support members with a top member extending between the tops of the first and second upright members with a plurality of puck deflector members hanging downward from the top member. These puck deflector members in one embodiment can be in the form of a plurality of hanging chains spaced apart from one another a specific distance, such as 4–5 inches apart, such that when a player shoots a puck moving above the ice through the hanging puck deflector members, the puck will frequently strike one of the puck deflector members and be deflected from its original path toward the goal area. Pucks are about 3 inches in diameter and only occasionally will they pass between a pair of adjacent puck deflector members that are approximately 4 inches apart from one another. This occasionally passing through shot without deflection helps keep the goalie guessing as to the pucks ultimate direction of travel. A base deflector having a plurality of angle members disposed on its angled upward surface can be positioned beneath the plurality of puck deflector members for deflecting pucks traveling on the surface of the ice and then traveling onto the surface of the base deflector to cause such pucks to be lifted upwards at an angle and be deflected by the angle members at a different direction of movement near the goal. The base deflector can be used in conjunction with the tip trainer or, if desired, can be used separately to cause a puck traveling onto the surface of the base deflector to become airborne at different angular paths for further testing and improvement of the skills of the goalie. In some embodiments of the invention the base deflector can have a generally planar surface with no angle members thereon.

DESCRIPTION OF THE PREFERRED EMBODIMENT(S)

Figure 1:
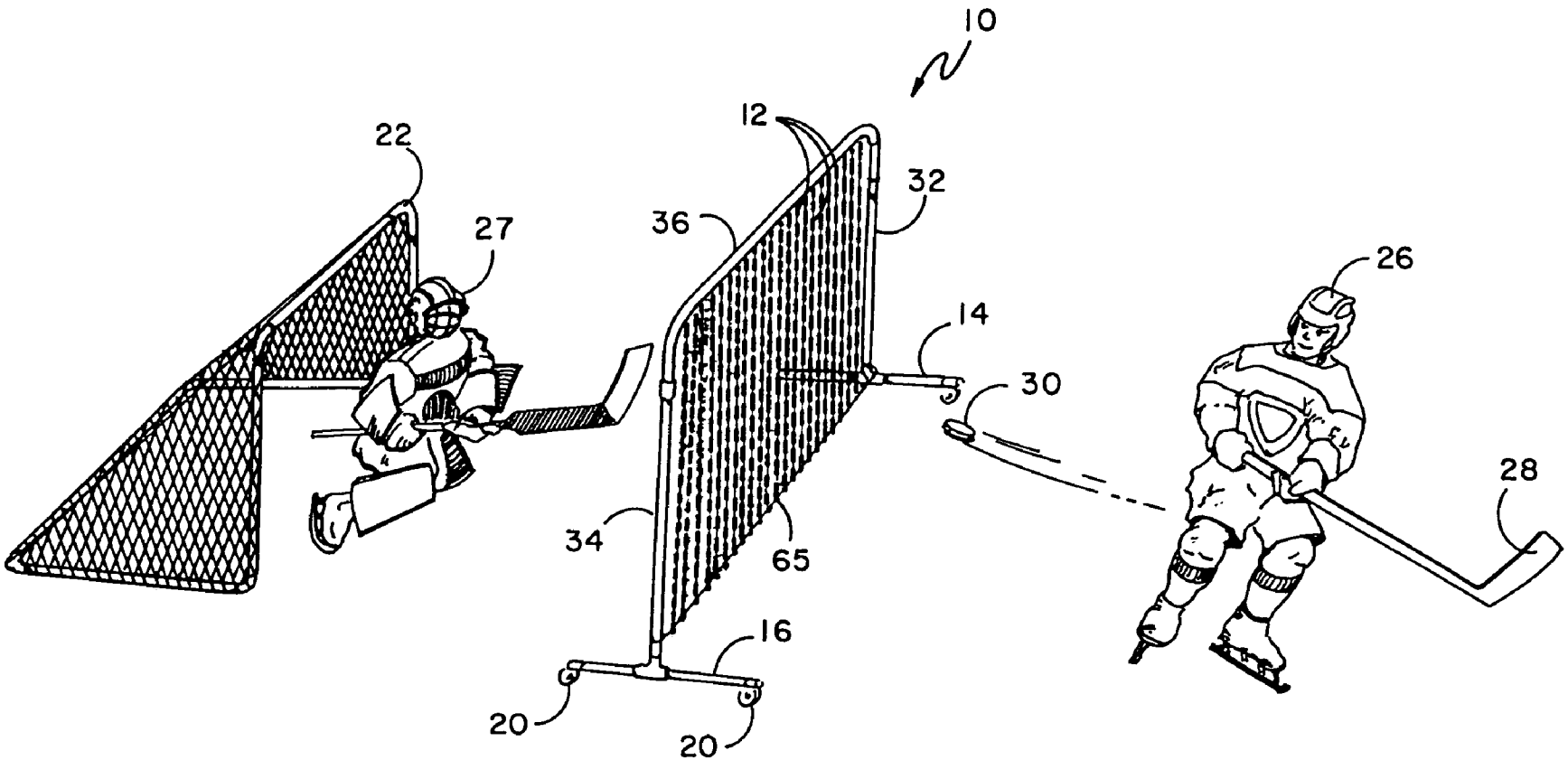
FIG. 1 illustrates a side perspective view of the tip training device of this invention disposed between a hockey player and a goal with a goalie positioned in front of the goal.
Figure 2:
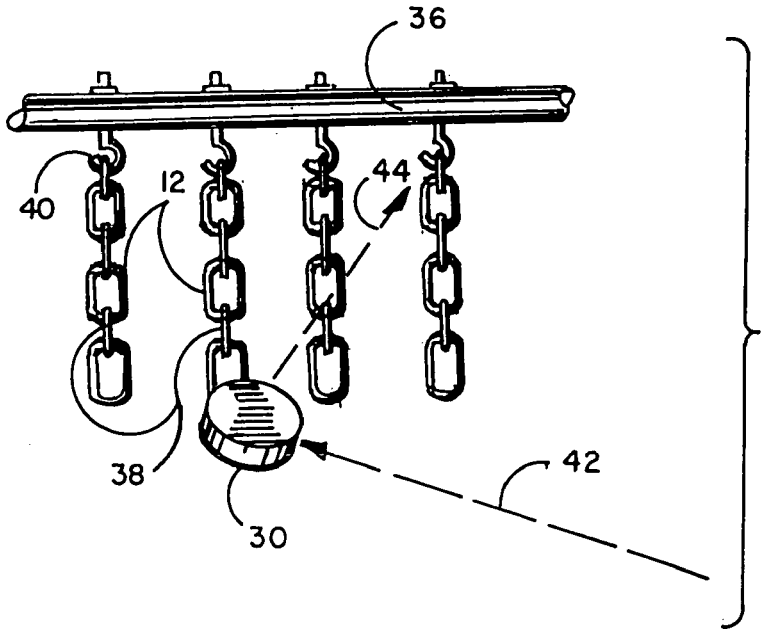
FIG. 2 illustrates an enlarged sectional view of a portion of the top member of the tip trainer with a plurality of puck deflector members hanging therefrom, showing the path of a puck traveling along a first path, then striking a puck deflector member, and then being deflected onto a second path.

FIG. 1 illustrates a side perspective view showing tip trainer 10 disposed in front of goalie 27 who is standing in front of hockey goal 22. Player 26 shoots puck 30 with hockey stick 28 such that the puck, as it passes through tip trainer 10, in most instances will come in contact with at least one of a plurality of puck deflector members 12 which in the embodiment shown in the enlarged view of FIG. 2, can be a plurality of vertically disposed hanging chains 38. As seen in FIG. 2 puck 30 travels along first path 42 from the point where it is first struck by a player's hockey stick. Puck 30 then strikes one of the puck deflector members 12 which, in the embodiment illustrated, are chains 38, and is then deflected from its original first path 42 to a second path 44 at an angle where goalie 27, who is positioned in front of the goal behind tip trainer 10, must then try to catch or block the deflected puck from entering the goal. Having little time to observe the puck's new direction of travel, the goalie must be constantly alert and must exercise quick reflexes to catch or block the deflected puck from entering the goal. While in a preferred embodiment the plurality of chains 38 can be provided in ⅜ inch or 5/16 inch sizes, it should be noted that the present invention is not limited to chains alone and that other materials for the puck deflector members can also be utilized, such as a plurality of heavy ropes, cables, wires, etc. Chains 38, as seen in FIG. 2, can be attached to top member 36 by eye bolts 40 which pass through spaced-apart apertures defined in top member 36; and nuts 58 can be tightened on the opposite end of eye bolts 40 to retain them in position. Other means of attachment can also be utilized. Puck deflector members 12, such as chains 38, can extend downward approximately 46 inches toward the ice. The spacing 39 between two adjacent puck deflector members can, in a preferred embodiment, be approximately 4½ inches although other spacings can accomplish the goals of this invention. However, if they are spaced too widely apart from one another, too many pucks might too easily pass between two puck deflector members without enough striking one of them sufficiently for deflection purposes. In some embodiments connection member 65, as seen in FIGS. 1 and 4, can be a rope or cable passing through the aperture in the bottom link of each chain or otherwise be attached to the bottom of each puck deflector member such as by tying to help retain the puck deflector members in position when struck by a puck which attachment helps prevent their moving around too much when struck by the puck.

Figure 3:
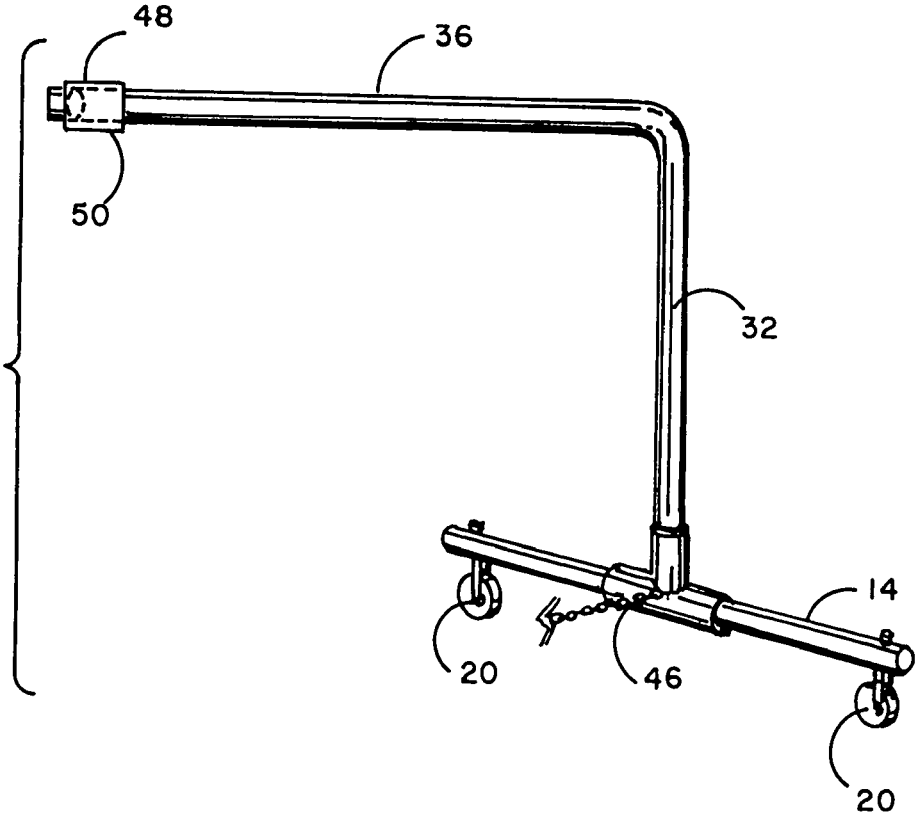
FIG. 3 illustrates a perspective view of a section of the framework with the top member being divided into a first and second portion that are joined together and being supported at one end on a first upright member which has at the bottom thereof a T-member receiving the second end of the first upright member.

FIG. 3 illustrates one-half of the framework of the device of this invention wherein top member 36 is composed of two parts: a first portion 52 and a second portion 54. Second portion 54 has a receipt member 48 defined at the end thereof into which insertion portion 50 of first portion 52 of top member 36 is inserted and attached with a screw or other tightening means. By having the top member 36 provided in two parts, the device of this invention can be easily shipped in a disassembled state. The top member, when assembled, can be in one embodiment approximately 84 inches in length. The top member can then be attached to, or integrally formed with, downwardly extending first upright 32 and attached to first support member 14 which structure is matched by an opposite second upright 34 and second support member 16, as seen in FIG. 1. The first and second upright members can each be approximately 48–50 inches in height. First support member 14 can be easily affixed to first upright 32 by attaching a first T member 46 to the bottom of first upright 32 wherein receipt area 47 of the first T member forms an aperture through which first support member 14 can easily pass during assembly and be tightened in place by a set screw and the like. The framework can be constructed of metal, plastic, wood or equivalent sturdy material. At each end of each support member can be wheels, such as wheels 20, so that tip trainer 10 can be moved about on the ice to a desired position.

Figure 4:
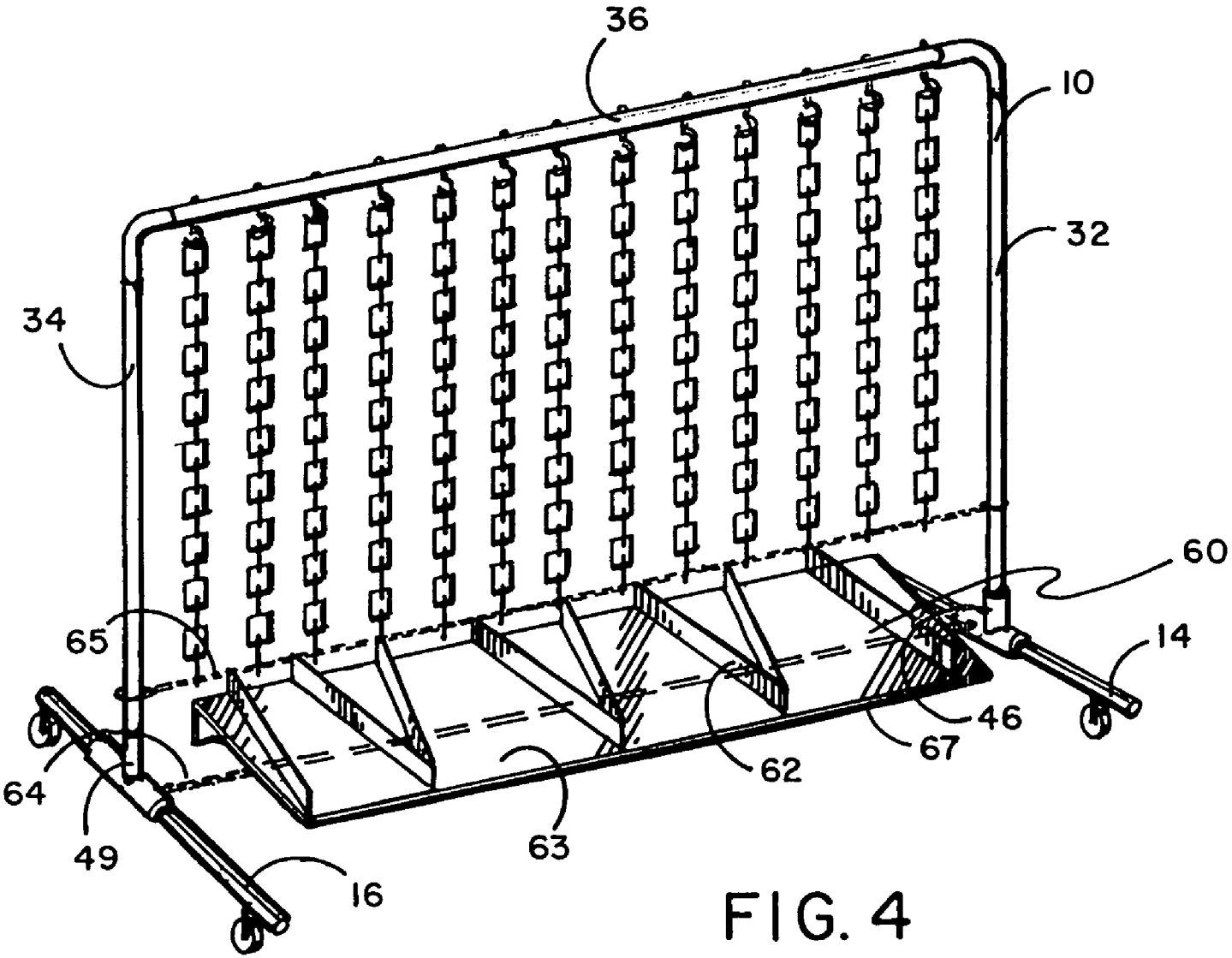
FIG. 4 illustrates a perspective view of the tip trainer used in conjunction with the base deflector of this invention.
Figure 5:
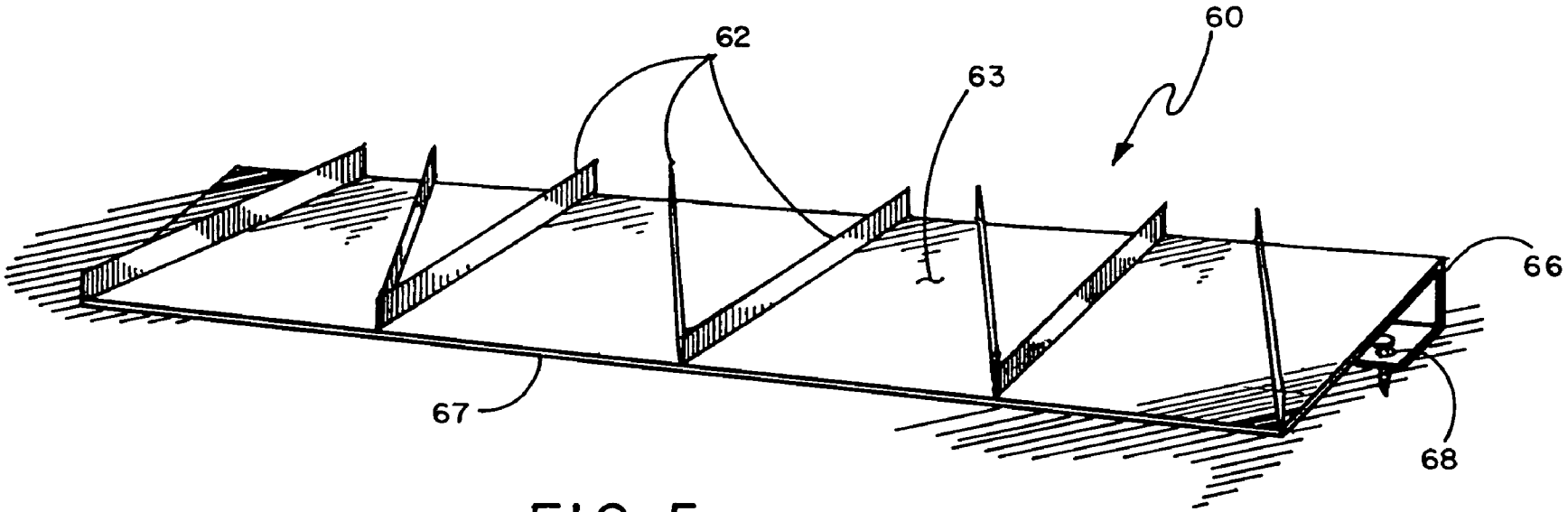
FIG. 5 illustrates a perspective view of the base deflector.

In some embodiments of the invention, as seen in FIGS. 4 and 5, a base deflector 60 can be utilized in conjunction with tip trainer 10. The base deflector can be positioned below hanging puck deflector members 12. Base deflector 60 has a planar surface 63 and in a preferred embodiment can be 60 inches wide and 8 inches deep. Surface 63 is angled upwards towards its rear from its front 67 which rests in close proximity to the ice. Base deflector 60 at its rear can be supported in a raised position by riser 66 which can be approximately 1 inch in height causing surface 63 to be disposed at an angle to the ice so that any puck coming from front 65 will slide at an upwards angle from the ice along surface 63. A height adjuster 68, as seen in FIG. 5, can be utilized to raise or lower riser 66, if desired. Other equivalent means of raising or lowering the upward angle of surface 63 can also be utilized. In an alternate embodiment base deflector 60 can have a plurality of angle members 62 disposed at various angles to one another on surface 63 which angle members 62 can extend upward about 1 inch perpendicular to surface 63 such that when a puck enters onto surface 63 at front 67 of base deflector 60, it will most times strike one of the angle members 62 and then rebound there off at a different angle than at the angle at which it was originally shot. A chain member 64, as seen in FIG. 4, extends between first T member 46 and second T member 49, respectively, on first and second support members 14 and 16 to help hold the support members together and prevent them from spreading apart as well as to help anchor and retain the position of base deflector 60 which can be engaged to chain member 64 either in front of, or under, puck deflector members 12.

Figure 6:
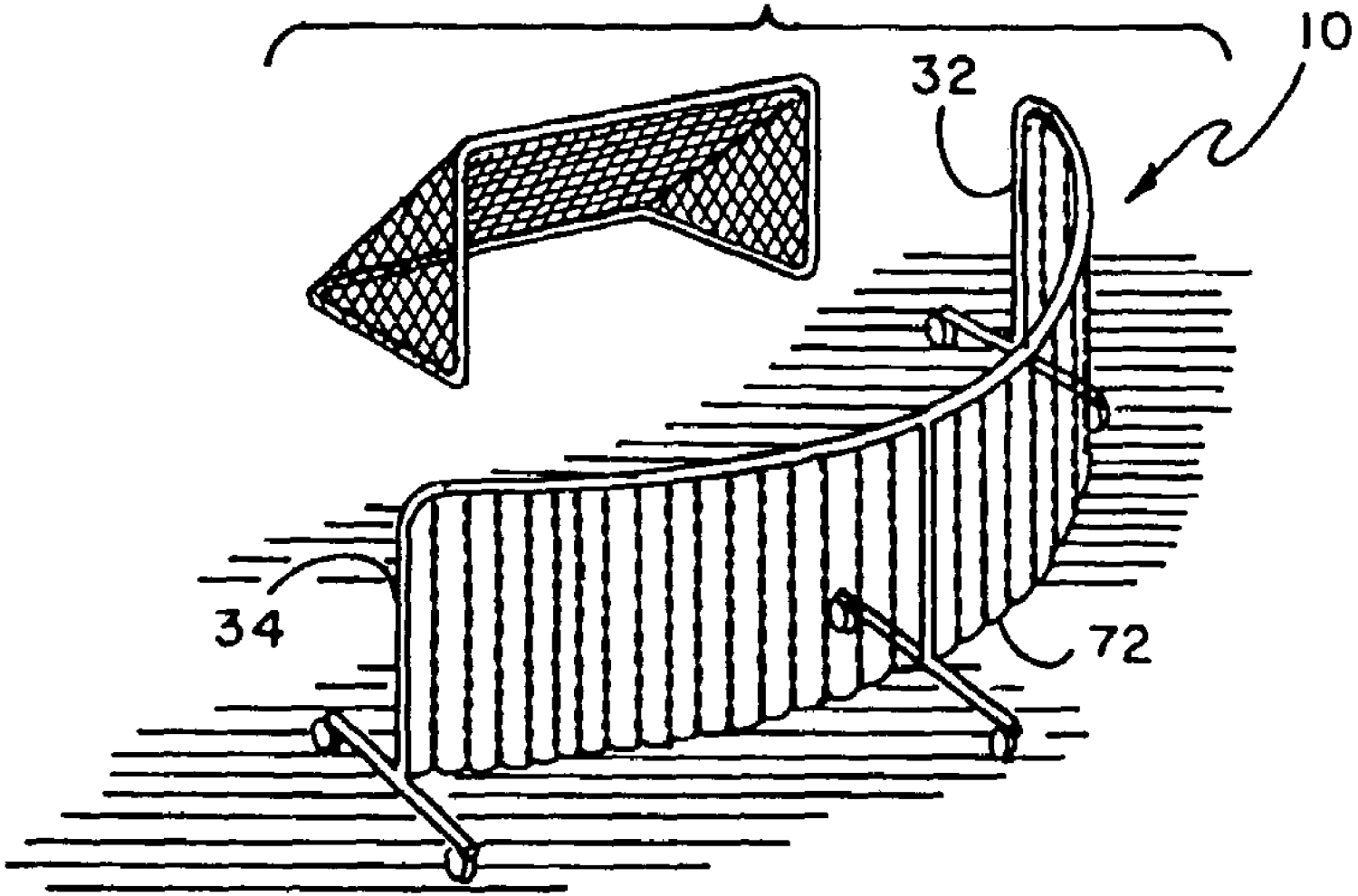
FIG. 6 illustrates a perspective view of the embodiment of the tip trainer having a curved top member.

FIG. 6 illustrates an embodiment of tip trainer 10 having a curved top member 70 which structure can be advantageous for utilization during training sessions when hockey players are shooting pucks at various angles from positions other than directly in front of and toward the goal. Curved member 70 can be positioned approximately 7 feet in front of the goal and extend as much as 180 degrees to form a half-circle with a diameter of approximately 14 feet around the front of the hockey goal crease so that a puck striking the tip trainer of this embodiment from a wide angle in front of the tip trainer can be deflected in most instances by a vertically disposed, hanging puck deflector member, as provided in the tip trainer of this invention. When using a tip trainer having a curved top member, a third upright 72 and its related third support member can be utilized to help support this embodiment of the tip trainer.

Although the present invention has been described with reference to particular embodiments, it will be apparent to those skilled in the art that variations and modifications can be substituted therefor without departing from the principles and spirit of the invention.

I claim:

1. An ice hockey training device for use on ice, said device disposed in front of a hockey goal, comprising:

a plurality of vertically disposed puck deflector members arrayed in a series, each of said puck deflector members having a first end and a second end, said plurality of puck deflector members disposed in front of a hockey goal for deflection of hockey pucks shot through said plurality of vertically disposed puck deflector members;

a base deflector for placement on said ice in front of said hockey goal, said base deflector having a planar surface which is angled upwards from the surface of said ice toward said hockey goal; and a plurality of angle members disposed on said surface of said base deflector for deflecting pucks that are shot along the surface of the ice onto the surface of said base deflector, said angle members causing said pucks to move at an upwards angle and to be deflected at various angles.

2. The device of claim 1 wherein said angle members on said base deflector are disposed at various angles to one another.

* * * * *